US011353306B1

(12) United States Patent
Bach

(10) Patent No.: US 11,353,306 B1
(45) Date of Patent: Jun. 7, 2022

(54) SHELL RELOADER DEVICE

(71) Applicant: Dennis Bach, Pierre, SD (US)

(72) Inventor: Dennis Bach, Pierre, SD (US)

( * ) Notice: Subject to any disclaimer, the term of this patent is extended or adjusted under 35 U.S.C. 154(b) by 0 days.

(21) Appl. No.: 17/115,376

(22) Filed: Dec. 8, 2020

(51) Int. Cl.

| | |
|---|---|
| ***F42B 33/00*** | (2006.01) |
| ***F42B 33/10*** | (2006.01) |
| ***F42B 33/04*** | (2006.01) |
| ***F42B 33/12*** | (2006.01) |
| *F42B 33/02* | (2006.01) |

(52) U.S. Cl.
CPC ..... *F42B 33/10* (2013.01); *F42B 33/04* (2013.01); *F42B 33/12* (2013.01); *F42B 33/0207* (2013.01)

(58) Field of Classification Search
CPC ..... F42B 33/00; F42B 33/001; F42B 33/04; F42B 33/12; F42B 33/10
See application file for complete search history.

(56) References Cited

U.S. PATENT DOCUMENTS 937,604 A * 10/1909 Hodge ..... F42B 33/04 86/36
1,066,980 A * 7/1913 Bailey ..... F42B 33/001 86/12
1,474,355 A * 11/1923 Fraser ..... F42B 33/001 86/23
2,031,850 A * 2/1936 Peterson ..... F42B 33/04 86/27
2,061,977 A * 11/1936 Newcomb ..... F42B 33/04 86/23
2,819,644 A * 1/1958 Corcoran ..... F42B 33/02 86/23
3,001,436 A * 9/1961 Deitemeyer ..... F42B 33/004 86/25
3,057,247 A * 10/1962 Alfrede ..... F42B 33/004 86/25
3,110,214 A 11/1963 Hess, Sr.
3,113,483 A * 12/1963 Puth ..... F42B 33/004 86/23
3,336,829 A * 8/1967 Lee ..... F42B 33/004 86/23
3,376,781 A * 4/1968 Swanson ..... F42B 33/04 86/25
3,450,000 A * 6/1969 Ponsness ..... F42B 33/10 86/25
3,693,497 A * 9/1972 Jacobitz ..... F42B 33/04 86/28
3,702,089 A 11/1972 Bachhuber
3,732,774 A * 5/1973 Griffin ..... F42B 33/004 86/23
3,771,411 A * 11/1973 Hazel ..... F42B 33/004 86/27

(Continued)

*Primary Examiner* — Derrick R Morgan

(57) ABSTRACT

A shell reloader device simultaneously performs multiple steps to allow reloading of a plurality of ammunition shells in a reduced time. The shell reloader device includes a press including a fixed section, a linkage, and a handle pivotally coupled to the fixed section. The handle is coupled to the linkage wherein the linkage is moved relative to the fixed section by operation of the handle. A compressor is operationally coupled to the press such that the compressor provides compression to each of a plurality of stations when the handle is operated. Each of the stations holds a respective shell in a position to be acted upon by the compressor for respective associated steps in reloading each shell.

16 Claims, 11 Drawing Sheets

(56) References Cited

U.S. PATENT DOCUMENTS 4,065,997 A * 1/1978 Allen ..... F42B 33/10 86/23
4,078,472 A * 3/1978 Simpson ..... F42B 33/10 86/23
4,133,249 A * 1/1979 Bachhuber ..... F42B 33/10 86/23
4,177,711 A * 12/1979 Lee ..... F42B 33/04 86/25
4,188,855 A * 2/1980 Alberts ..... F42B 33/04 86/23
4,522,102 A 6/1985 Pickens
4,637,291 A * 1/1987 Alexander ..... F42B 33/04 86/1.1
4,723,472 A * 2/1988 Lee ..... F42B 33/10 86/23
4,836,078 A * 6/1989 Lee ..... F42B 33/005 86/23
5,040,449 A * 8/1991 Lee ..... F42B 33/004 86/27
5,177,315 A * 1/1993 Burgess ..... F42B 33/004 86/23
5,202,529 A 4/1993 Shields
5,221,806 A * 6/1993 Chaney ..... F42B 33/04 86/19
5,649,465 A * 7/1997 Beebe ..... F42B 33/10 86/1.1
5,900,574 A 5/1999 Hart
6,318,226 B1 * 11/2001 Swedberg ..... F42B 33/00 83/164
6,772,668 B2 * 8/2004 Shields ..... F42B 33/0207 86/31
9,605,936 B1 * 3/2017 Burgan ..... F42B 7/08
10,794,676 B1 * 10/2020 Aerni ..... F42B 33/10
2004/0025677 A1 * 2/2004 Koch ..... F42B 33/10 86/24
2004/0025678 A1 * 2/2004 Shields ..... F42B 33/02 86/31
2010/0037758 A1 * 2/2010 Lee ..... F42B 33/00 86/23
2013/0139675 A1 * 6/2013 Baxter ..... F42B 33/001 86/31

* cited by examiner

SHELL RELOADER DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to shell reloading devices and more particularly pertains to a new shell reloading device for simulataneously performing required steps for reloading ammunition shells using a single reloading press mechanism. Thus, multiple shells can be acted upon simultaneously and the device can be set a single time prior to processing multiple shells in a significantly reduced time.

(2) Description of Related Art Including Information Disclosed Under 37 CFR 1.97 and 1.98

The prior art relates to shell reloading devices. Conventional reloading presses act upon a single shell at a time. To avoid resetting of the device for each step, a number of shells are typically run through a single step before each shell is then run through a subsequent step.

BRIEF SUMMARY OF THE INVENTION

An embodiment of the disclosure meets the needs presented above by generally comprising a press including a fixed section, a linkage, and a handle pivotally coupled to the fixed section. The handle is coupled to the linkage wherein the linkage is moved relative to the fixed section by operation of the handle. A compressor is operationally coupled to the press such that the compressor provides compression to each of a plurality of stations when the handle is operated. Each of the stations holds a respective shell in a position to be acted upon by the compressor for respective associated steps in reloading each shell.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
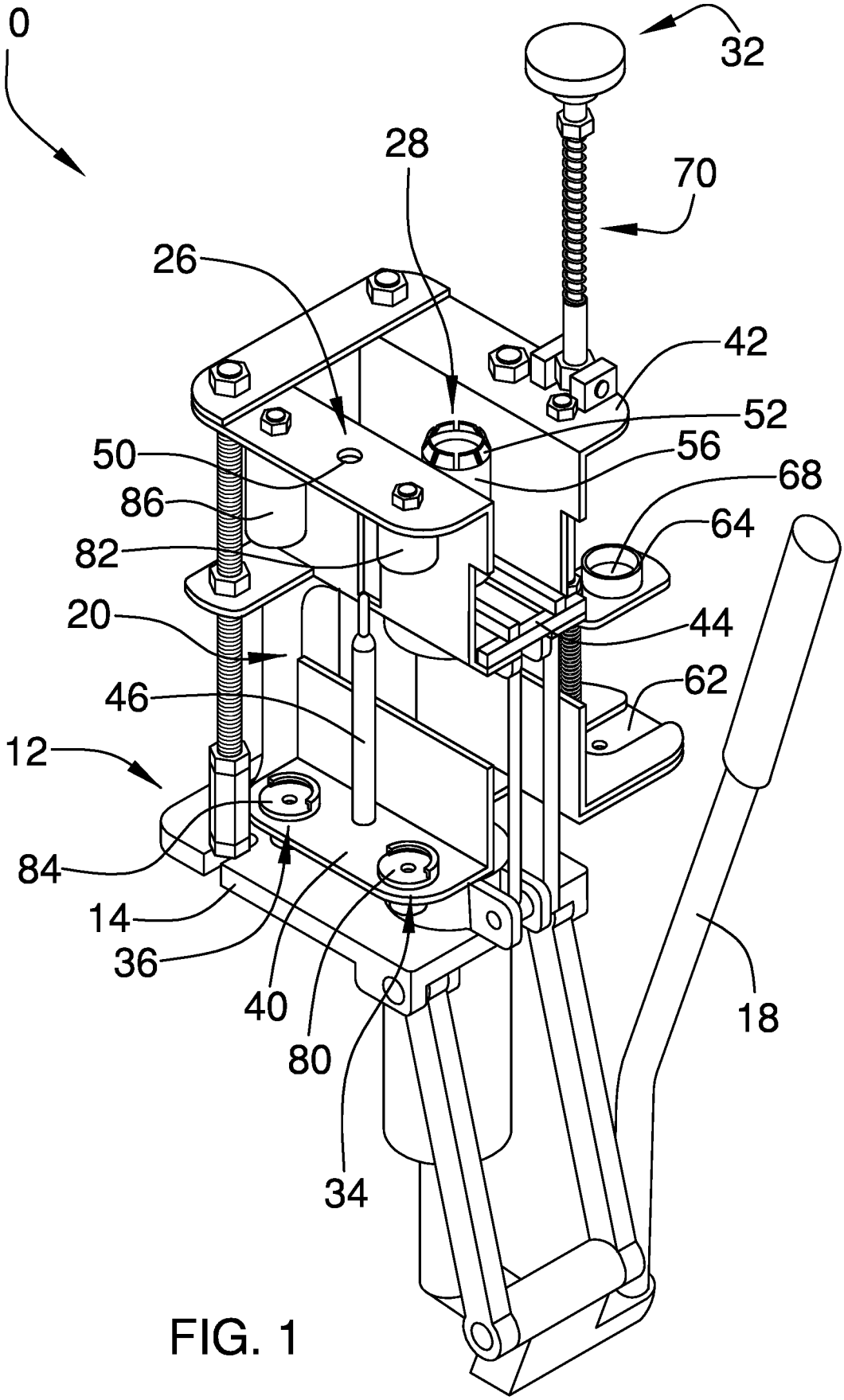
FIG. 1 is a top front side perspective view of a shell reloader device according to an embodiment of the disclosure.
Figure 2:
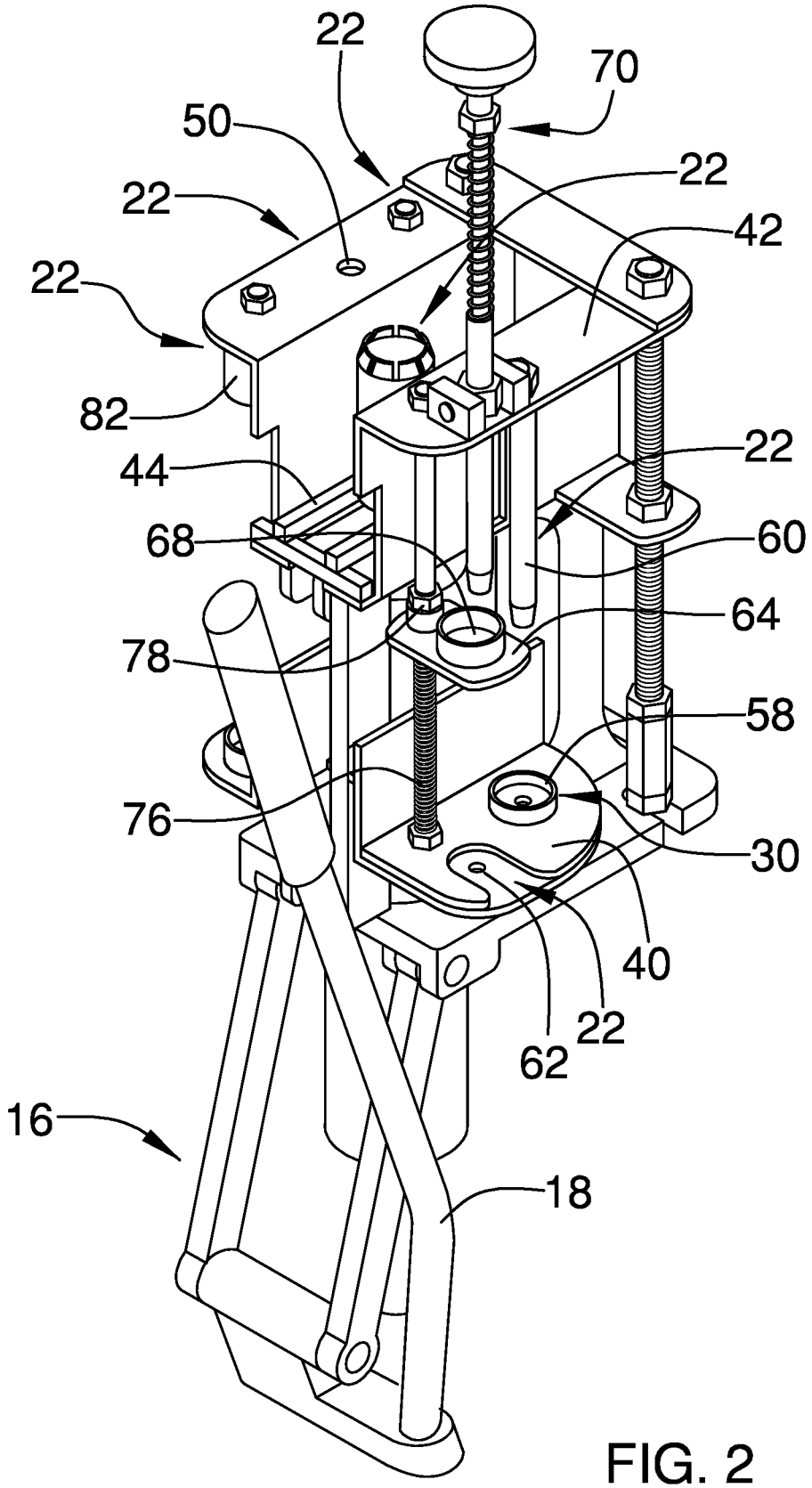
FIG. 2 is a top front side perspective view of an embodiment of the disclosure.
Figure 3:
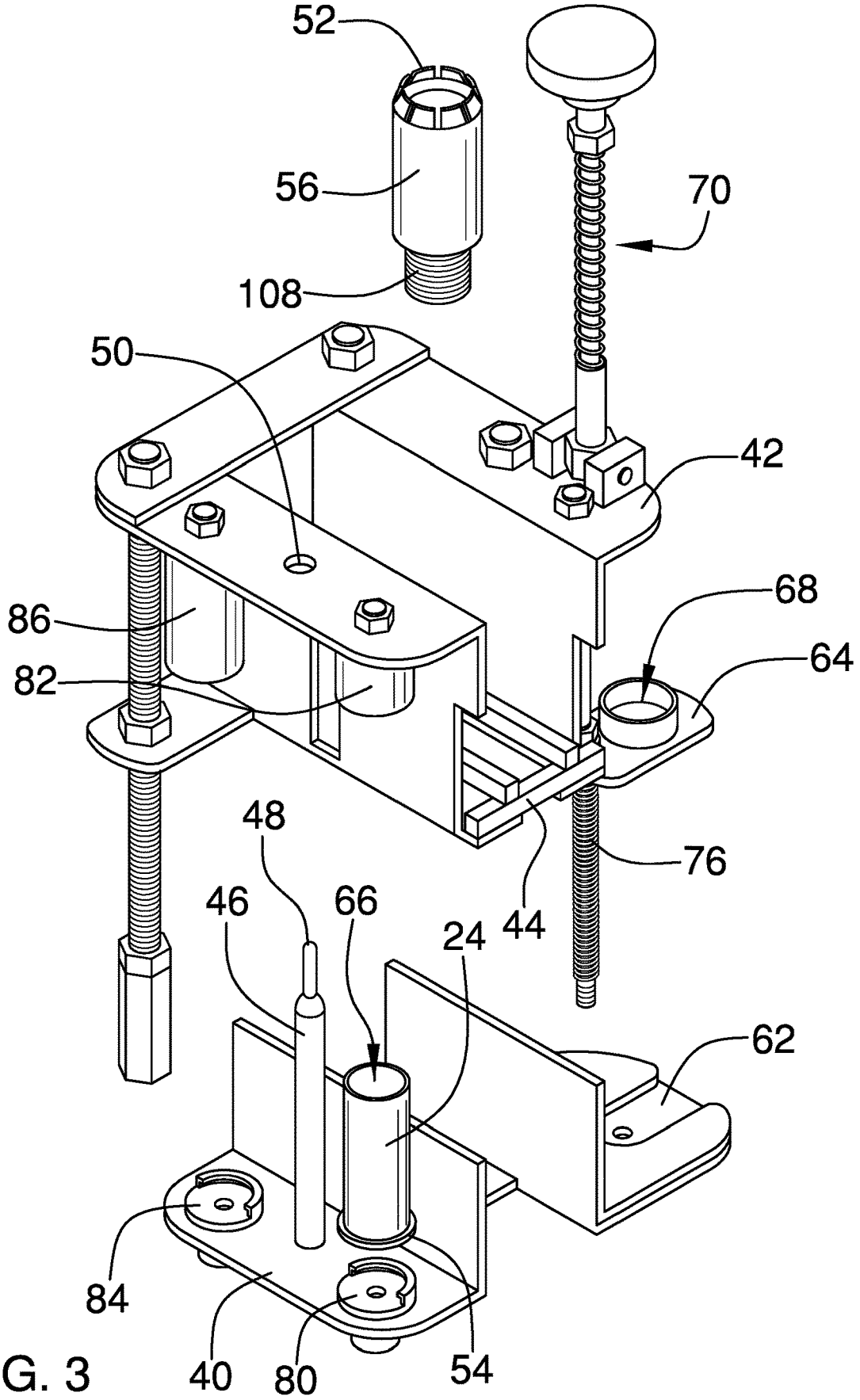
FIG. 3 is a partially exploded top side perspective view of an embodiment of the disclosure.
Figure 4:
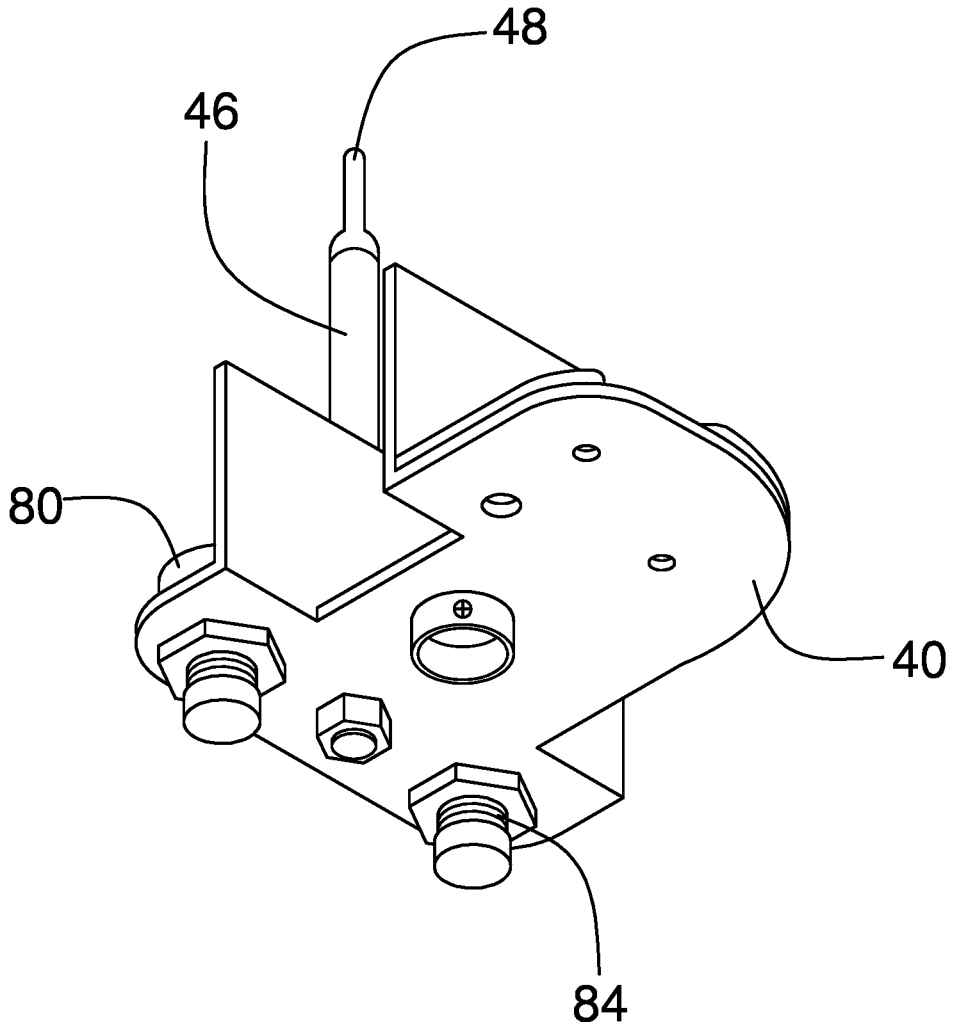
FIG. 4 is a bottom side perspective view of a base section of a compressor of an embodiment of the disclosure.
Figure 5:
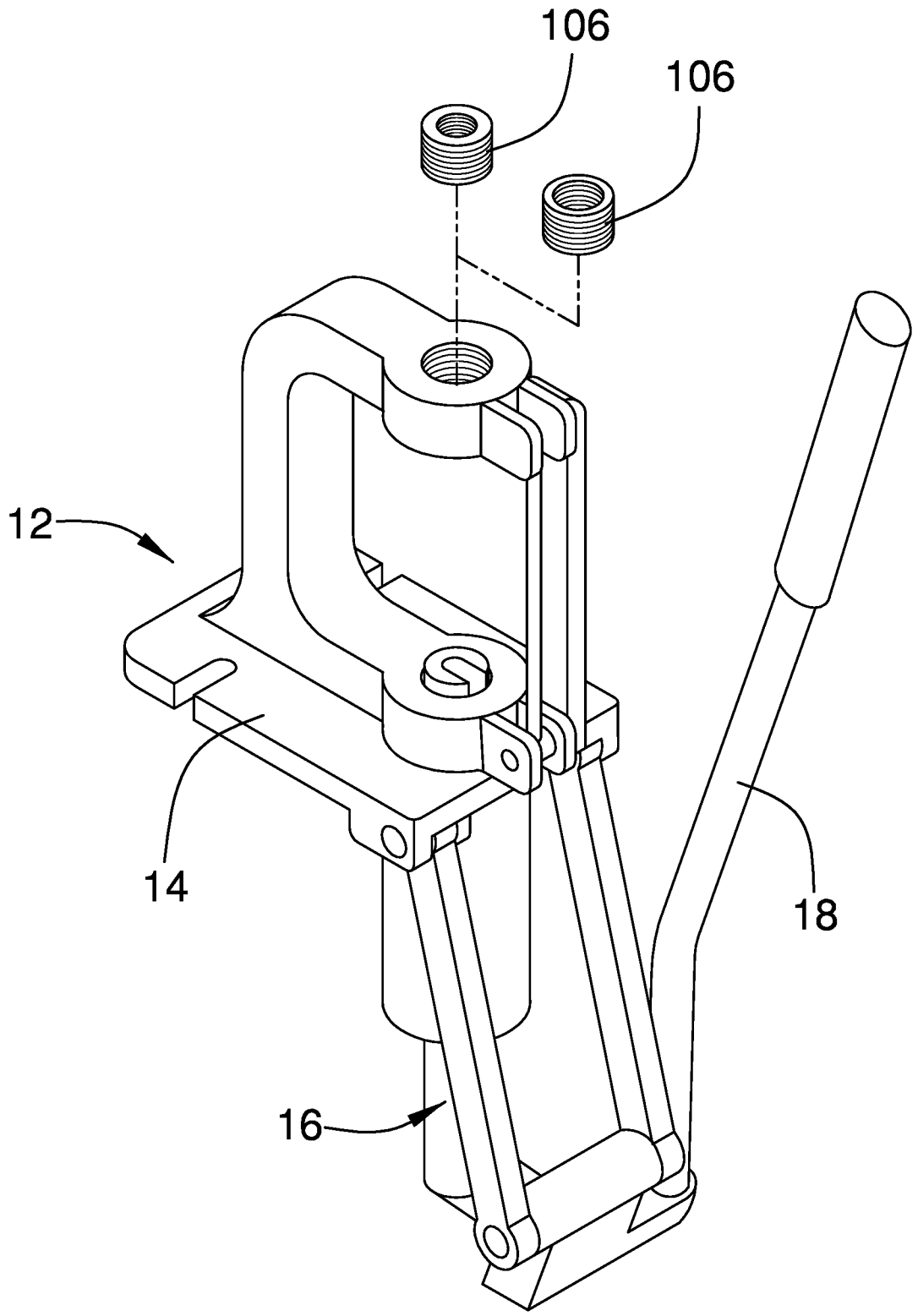
FIG. 5 is a top front side perspective view of a press of an embodiment of the disclosure.
Figure 6:
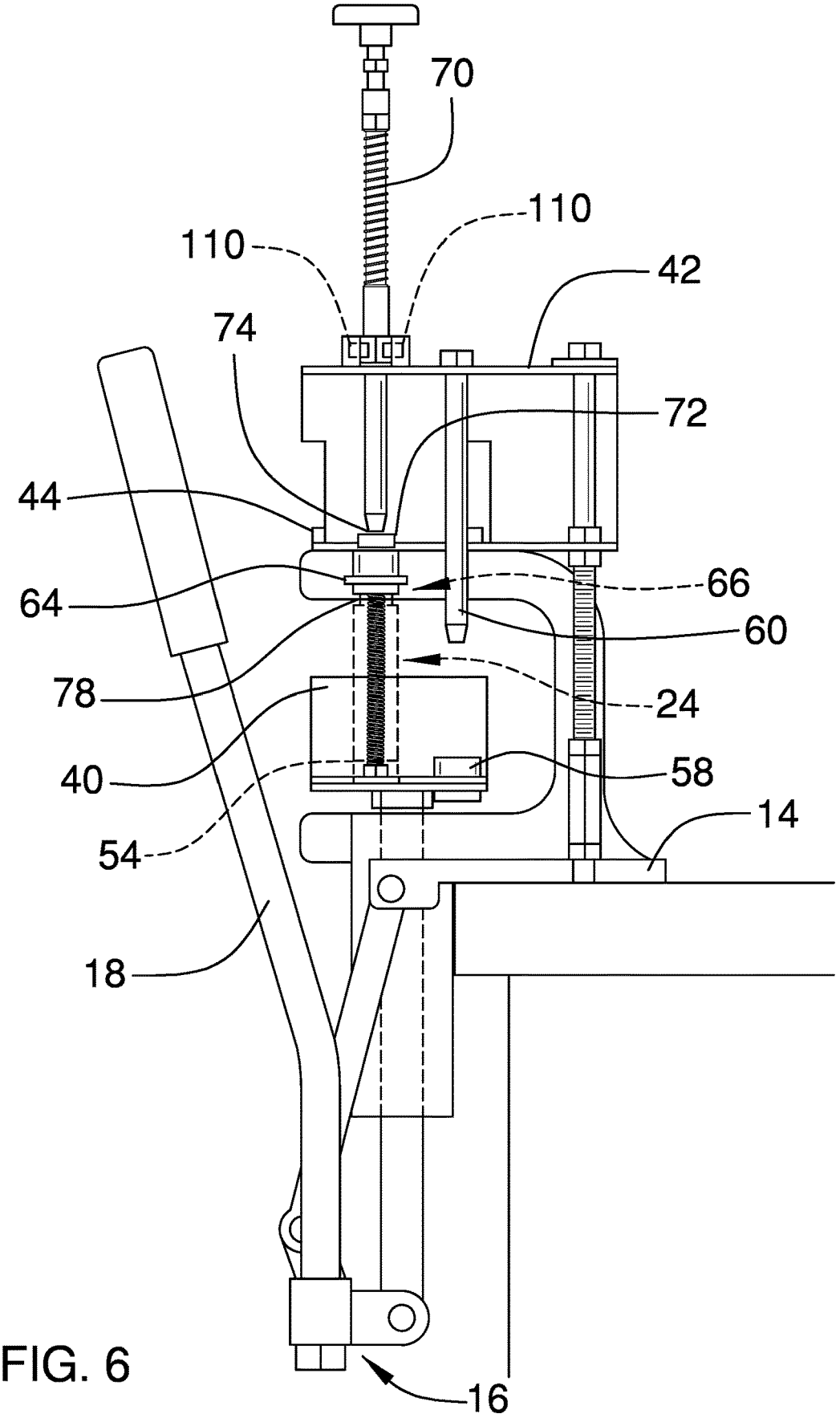
FIG. 6 is a side view of an embodiment of the disclosure.
Figure 7:
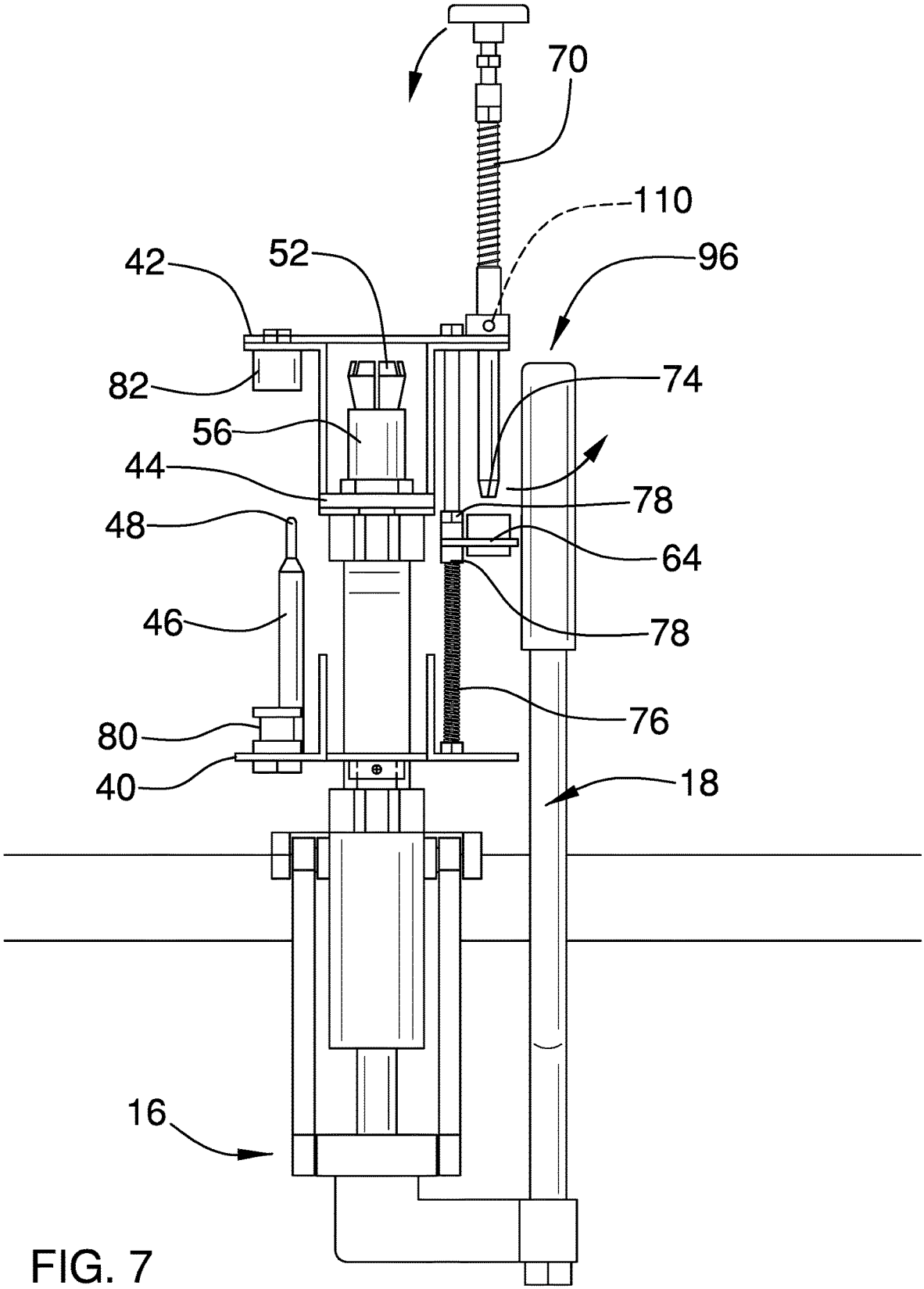
FIG. 7 is a front view of an embodiment of the disclosure.
Figure 8:
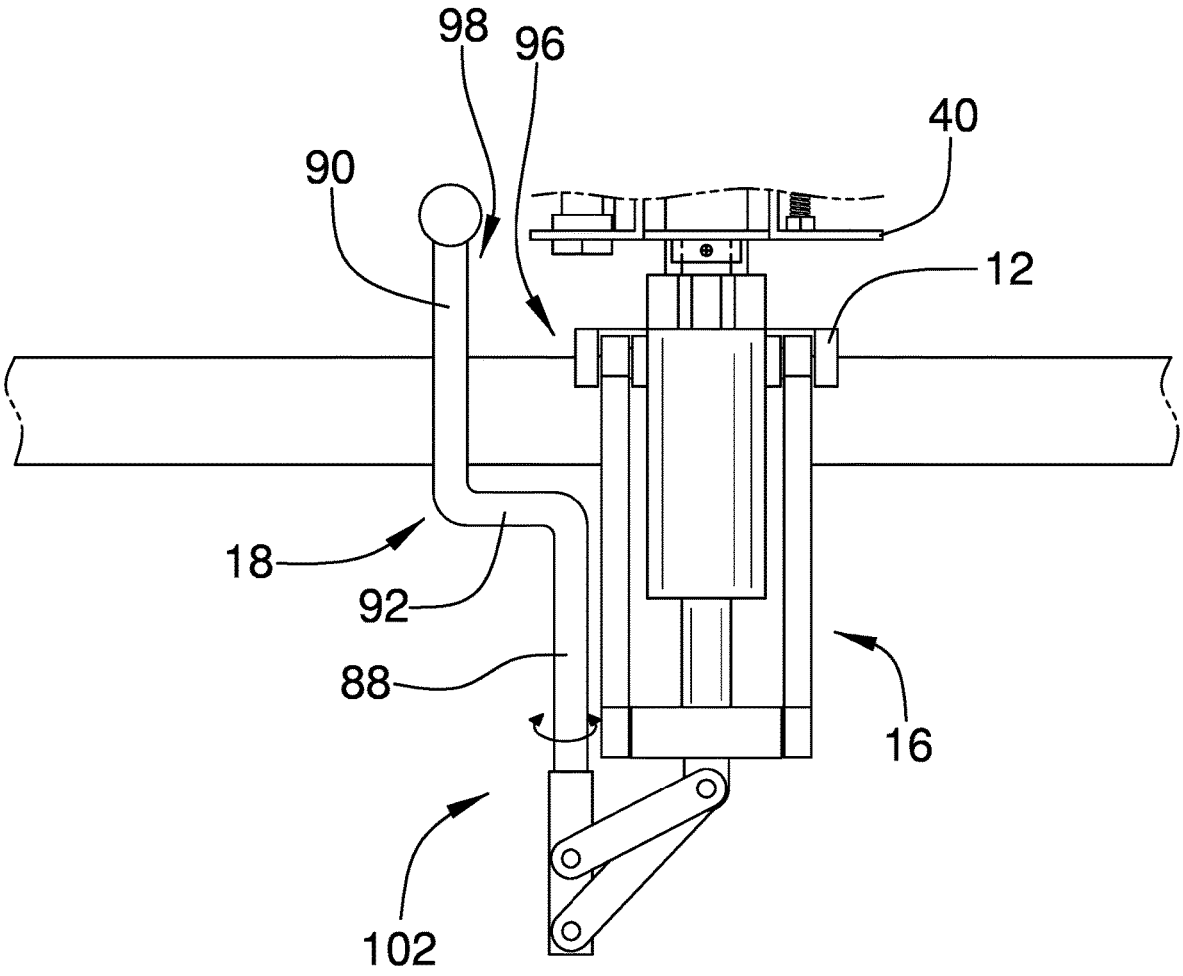
FIG. 8 is a front view of an embodiment of the disclosure with an alternative handle configuration in a raised and unpivoted position.
Figure 9:
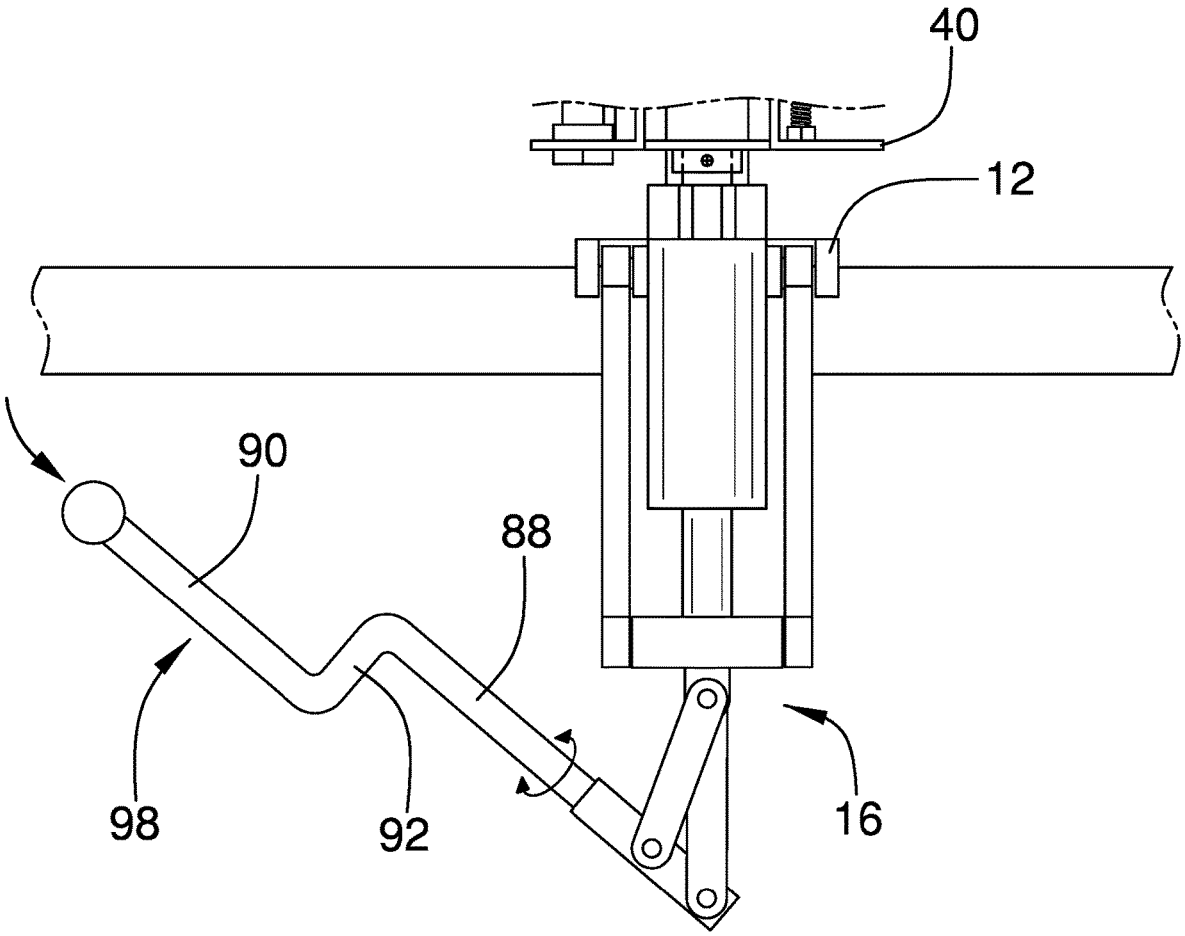
FIG. 9 is a front view of an embodiment of the disclosure with the alternative handle configuration in a partially lowered and unpivoted position.
Figure 10:
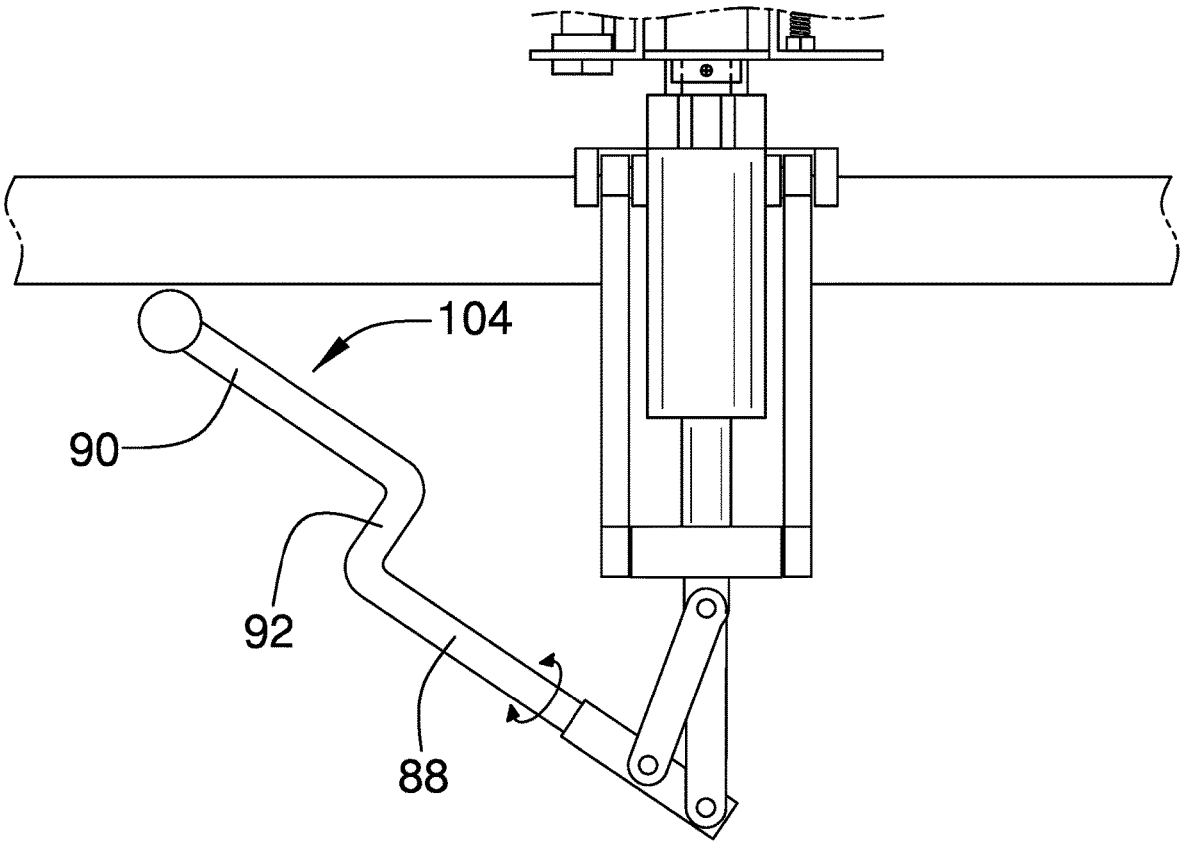
FIG. 10 is a front view of an embodiment of the disclosure with the alternative handle configuration in a partially lowered and pivoted position.
Figure 11:
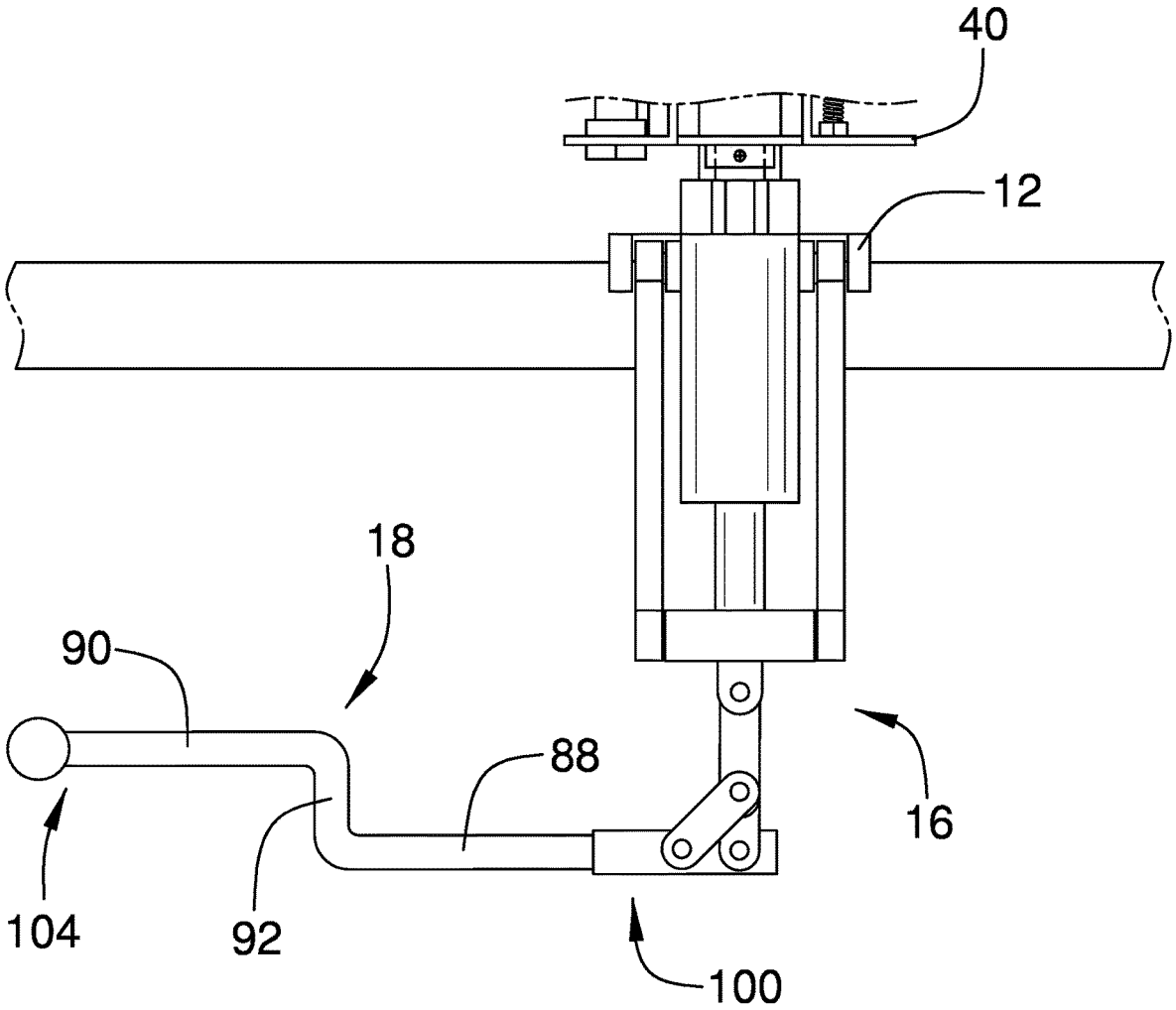
FIG. 11 is a front view of an embodiment of the disclosure with the alternative handle configuration in a fully lowered and pivoted position.

With reference now to the drawings, and in particular to FIGS. 1 through 11 thereof, a new shell reloading devices embodying the principles and concepts of an embodiment of the disclosure and generally designated by the reference numeral 10 will be described.

As best illustrated in FIGS. 1 through 11, the shell reloader device 10 generally comprises a press 12 comprising a fixed section 14, a linkage 16, and a handle 18 pivotally coupled to the fixed section 14. The handle 18 is coupled to the linkage 16 wherein the linkage 16 is moved relative to the fixed section 14 by operation of the handle 18. Movement of the linkage 16 provides for movement of the linkage towards the fixed section 14 to provide a compressing motion. The press 12 may be specifically made for use as described herein or may be achieved through reversible conversion of an existing press of the type used for reloading rifle and handgun ammunition. Thus, a single press 12 may be used for reloading of both shotgun shells and rifle or handgun shells.

A compressor 20 is removably coupled to the press 12. The compressor 20 is operationally coupled to the press 12 such that the press 12 acts on the compressor 20 instead of upon a shaft or piston as in a conventional reloading press. The compressor 20 provides compression to each of a plurality of stations 22 when the handle 18 is operated. Each of the stations 22 is configured for holding a respective one of a plurality of shells 24 such that each respective shell 24 is positioned to be acted upon by the compressor 20 for respective associated steps in reloading each shell 24. The plurality of stations 22 includes a primer removal station 26, a resizing station 28, a primer insertion station 30, a wad insertion station 32, an initial crimping station 34, and a final crimping station 36. Each of the stations 22 is operated by manipulation of the handle 18. The stations 22 may be all used simultaneously by a single use of the handle 18. The stations 22 are also independent of each other meaning that each station 22 may act on the respective shell 24 whether or not any other station 22 is or is not simultaneously acting on another shell 24. The compressor 20 comprises a base section 40 couplable to the linkage 16 of the press 12 in a conventional manner wherein the base section 40 moves with the linkage 16. A top section 42 is coupled to the press 12 in a static position relative to the fixed section 14 of the press 12. Thus, the base section 40 is moved towards the top section 42 by operation of the handle 18 of the press 12. The range of motion of the base section 40 relative to the top section 42 is generally larger than may be needed for at least one of the stations 22. The compressor 20 includes a medial frame 44 supported between the top section 42 and the base section 40 in a resting position spaced over the base section 40. The medial frame 44 is engaged by the bottom section 40 part way through the full range of motion between the base section 40 and the top section 42 effectively providing a second smaller range of motion for the medial frame 44 than for the base section 40. The medial frame 44 is moved toward the top section 42 when the base section 40 is moved fully towards the top section 42.

The primer removal station 26 comprises a primer removal post 46 coupled to and extending vertically upwards from the base section 40. The primer removal post 46 has a distal end 48 relative to the base section 40. A primer removal aperture 50 extends through the top section 42. The primer removal aperture 50 is vertically aligned with the primer removal post 46 such that the distal end 48 of the primer removal post 46 extends through the primer removal aperture 50 when the compressor 20 is fully compressed. Thus, the primer removal post 46 is configured to push a used primer out of a shell 24 positioned in the primer removal station 26 and through the primer removal aperture 50 where the used primer may be removed for disposal.

The resizing station 28 comprises a collet 52 coupled to the top section 42 of the compressor 20. The collet 52 has a threaded connection base 108 for connection to the press 12. An appropriately sized adapter 106 may be used for connection of variously sized collets 52 as desired. The range of motion required for resizing of a brass head 54 of the shell 24 is less than for the other stations 22. Thus, a sleeve 56 is coupled to the medial frame 44. The sleeve 56 is positioned to compress the collet 52 wherein the collet 52 is configured for compressing and resizing the brass head 54 of the shell 24 inserted into the collet 52. Each of the collet 52 and the sleeve 56 is removably coupled to the compressor 20 such that the collet 52 and sleeve 56 are interchangeable with a differently sized second collet and second sleeve. It is understood that one of ordinary skill in the art would understand interchangeable parts would require similar conventional coupling to the compressor 20 in combination with changes to the size of the collet 52 and sleeve 56 to provide the various sizes desired for resizing. Thus, the compressor 20 is configurable for resizing to a selectable desired shell size.

The primer insertion station 30 comprises a priming mechanism 58. The priming mechanism 58 is a generally conventional mechanism which would be known to one skilled in the art as it is currently used for insertion of a primer into a shell. Generally, the priming mechanism 58 supports a new primer while allowing the brass head of a shell to be positioned in proper alignment for compression such that the supported new primer is urged into the primer space in the brass head of the shell. The priming mechanism 58 is coupled to the base section 40 in a conventional manner. This may include use of a slot directly in the base section 40 or in a support coupled to the base section 40. The priming mechanism 58 is configured to receive the new primer and have the shell 24 positioned on the priming mechanism 58 over the new primer. A rod 60 is coupled to the top section 42. The rod 60 is aligned over the priming mechanism 58 wherein the rod 60 is configured to compress the shell 24 against the priming mechanism 58 wherein the new primer is inserted into the shell 24 when the handle 18 is operated. The rod 60 is interchangeable to accommodate insertion of primers for different sized shells.

The wad insertion station 32 comprises a wad insertion seat 62 is coupled to the base section 40. The wad insertion seat 62 is configured for engaging the brass head of the shell 24 after a proper powder charge is placed into the shell 24. A wad insertion guide 64 coupled to the base section 40 and positioned over the wad insertion seat 62 such that the wad insertion guide 64 is configured to engage and hold an open end 66 of the shell 24. The wad insertion guide 64 has a wad insertion opening 68 configured to be aligned with the open end 66 of the shell 24. A wad tamper 70 is coupled to the top section 42 of the compressor 20 wherein the wad tamper 70 is insertable through the wad insertion opening 68 such that the wad tamper 70 is configured for pressing a wad 72 inserted into the open end 66 of the shell 24 towards the brass head when the handle 18 is operated. By proper spacing of the wad insertion guide 64 and a bottom end 74 of the wad tamper 70, the wad 72 can be placed on the wad insertion guide 64 and held upright by the wad tamper 70 sufficiently that the wad 72 will be driven into the shell 24 upon operation of the handle 18 without needing to be held by hand. This requires closeness which may interfere with positioning of the wad 72. To address this issue, the wad tamper 70 is pivotable, using set screws 110 or similar conventional mechanisms, relative to the fixed section 14 into a wad loading position wherein the bottom end 74 of the wad tamper 70 is angled laterally away from the wad insertion opening 68 wherein the wad tamper 70 is configured for facilitating positioning of the wad 72 onto the wad tamper 70 before pivoting the wad tamper 70 back into alignment with the wad insertion opening 68. The wad tamper 70 is slidable towards the wad insertion seat 62 wherein the wad tamper 70 is configured for tamping the wad 72 further into the shell 24 after the compressor 20 is fully compressed. This insures the wad 72 is properly compressed against the powder charge. A distance between the wad insertion guide 64 and the wad insertion seat 62 when the compressor is fully compressed is adjustable. One manner of achieving this adjustment is as shown wherein a threaded rod 76 is fixed extending up from the base section 40. Nuts 78 are used to secure the wad insertion guide 64 at a desired position along the threaded rod 76. Alternatively, or in combination with the above adjustment, the wad insertion seat 62 may be coupled to the base section 40 at an adjustable effective height either by interchangeable seats of varying heights or by use of an adjustable height intermediate support structure between the base section 40 and the wad insertion seat 62. Thus, the wad insertion station 32 is configured for holding and inserting wads into shells having a variety of different lengths. Each of the wad insertion seat 62 and wad insertion guide 64 may also be interchangeable with alternative pieces to accommodate variations in size such as ten or twelve gauge shells.

The initial crimping station 34 comprises an initial crimping seat 80 coupled to the base section 40 of the compressor 20. An initial crimping mold 82 is coupled to the top section 42 of the compressor 20 and vertically aligned over the initial crimping seat 80. Initial crimping molds are conventionally known and provided with a lip which may be used to engage a slot or socket in the top section 42 to position the initial crimping mold 82 consistently over the initial crimping seat 80. The initial crimping mold 82 is spaced from the initial crimping seat 80 such that the initial crimping mold 82 is configured to begin crimping of the open end 66 of the shell 24 seated in the initial crimping seat 80 after the shell 24 is filled with shot. A distance between the initial crimping seat 80 and the initial crimping mold 82 when the compressor 20 is fully compressed is adjustable. This can be achieved in the same manner of adjustment as described above pertaining to the wad insertion seat 62. Thus, the initial crimping station 34 is configured for holding and initially crimping shells 24 having a variety of different lengths. The initial crimping seat 80 and initial crimping mold 82 are also replaceable to accommodate variously sized shells 24.

The final crimping station 36 is similar to the initial crimping station 34. The final crimping station 36 includes a final crimping seat 84 coupled to the base section 40 of the compressor 20. A final crimping mold 86 is coupled to the top section 42 of the compressor 20 and vertically aligned over the final crimping seat 84. The final crimping mold 86 is spaced from the final crimping seat 84 such that the final crimping mold 86 is configured to finish crimping of the shell 24 seated in the final crimping seat 84 to close the open end 66 of the shell 24 completing the overall reloading process. In the same manner as described above for the initial crimping station 34, a distance between the final crimping seat 84 and the final crimping mold 86 when the compressor 20 is fully compressed is adjustable. Thus, the final crimping station 36 is configured for holding and finally crimping shells 24 having a variety of different lengths. The final crimping seat 84 and final crimping mold 86 are also replaceable to accommodate variously sized shells 24.

The handle 18 may have a base portion 88, an upper portion 90, and an offset portion 92 between the base portion 88 and the upper portion 90. The base portion 88 is rotatably coupled to the fixed section 40 of the press 12 wherein the upper portion 90 of the handle 18 is selectively positionable between and end 94 of the press 12 and a side 96 of the press 12 when the handle 18 is in an unpivoted position 98. The handle 18 is rotatable such that the upper portion 90 is selectively positionable between a lowered position 100 and a raised position 102 while the handle 18 is in a pivoted position 104. Thus, the handle 18 may be initially pivoted until the upper portion 90 is in the lowered position 100. To increase leverage for completion of the full range of motion, the handle 18 is rotatable to the raised position 102 facilitating further pivoting of the handle 18 through the remainder of the range of pivoting motion for the handle 18.

In use, the device 10 provides for a method of reloading shells 24. The method comprises sequential steps moving individual shells 24 through the primer removal station 26, the resizing station 28, the primer insertion station 30, the wad insertion station 32, the initial crimping station 34, and the final crimping station 36. The method may include an initial step of running through each station with a single shell 24 to insure settings, spacing, and sizing of each station 22 prior to reloading multiple shells sequentially through the stations. The initial operation of the handle 18 will act upon one shell 24 with each subsequent operation adding an additional shell 24 to the sequential process until each station 22 is acting upon a respective shell 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A shell reloader device comprising:

a press including a fixed section, a linkage, and a handle pivotally coupled to said fixed section, said handle being coupled to said linkage wherein said linkage is moved relative to said fixed section by operation of said handle; and a compressor, said compressor being operationally coupled to said press such that said compressor provides compression to each of a plurality of stations when said handle is operated, each of said stations being configured for holding a respective shell such that said respective shell is positioned to be acted upon by said compressor for respective associated steps in reloading each shell, said compressor including a base section couplable to said linkage wherein said base section moves with said linkage, a top section, said top section being in a static position relative to said fixed section of said press wherein said base section is moved towards said top section by operation of said handle of said press, and a medial frame said medial frame being supported between said top section and said base section in a resting position over said base section, said medial frame being engaged by said bottom section and moved toward said top section when said base section is moved fully towards said top section; and wherein said plurality of stations includes a resizing station and at least one of a primer removal station, a resizing station, a primer insertion station, a wad insertion station, an initial crimping station, or a final crimping station, wherein said resizing station includes a collet coupled to said top section of said compressor, and a sleeve coupled to said medial frame, said sleeve being positioned to compress said collet wherein said collet is configured for compressing and resizing a brass head of a shell inserted into said collet.

2. The device of claim 1, wherein said plurality of stations includes said primer removal station, wherein said primer removal station comprises:

a primer removal post coupled to and extending vertically upwards from said base section, said primer removal post having a distal end relative to said base section, and a primer removal aperture extending through said top section, said primer removal aperture being vertically aligned with said primer removal post such that said distal end of said primer removal post extends through said primer removal aperture when said compressor is fully compressed wherein said primer removal post is configured to push a used primer out of a shell and through said primer removal aperture.

3. The device of claim 1, wherein said plurality of stations includes said primer insertion station, wherein said primer insertion station comprises:

a priming mechanism coupled to said base section, said priming mechanism being configured to receive a primer and have a shell positioned on said priming mechanism over the primer, and a rod coupled to said top section, said rod being aligned over said priming mechanism wherein said rod is configured to compress the shell against the priming mechanism wherein the primer is inserted into the shell when the handle is operated.

4. The device of claim 1, wherein said plurality of stations includes said wad insertion station, wherein said wad insertion station comprises:

a wad insertion seat coupled to said base section, said wad insertion seat being configured for engaging a brass head of a shell, a wad insertion guide coupled to said base section and positioned over said wad insertion seat such that said wad insertion guide is configured to engage and hold an open end of the shell, said wad insertion guide having a wad insertion opening configured to be aligned with the open end of the shell, and a wad tamper coupled to said top section of said compressor wherein said wad tamper is inserted through said wad insertion opening such that said wad tamper is configured for pressing a wad inserted into the open end of the shell towards the brass head when said handle is operated.

5. The device of claim 4, further comprising said wad tamper being slidable towards said wad insertion seat wherein said wad tamper is configured for tamping the wad into the shell after said compressor is fully compressed.

6. The device of claim 1, wherein said plurality of stations includes said initial crimping station, wherein said initial crimping station includes an initial crimping seat coupled to said base section of said compressor, an initial crimping mold coupled to said top section of said compressor and vertically aligned over said initial crimping seat, said initial crimping mold being spaced from said initial crimping seat such that said initial crimping mold is configured to begin crimping of an open end of a shell seated in said initial crimping seat.

7. The device of claim 1, wherein said plurality of stations includes said final crimping station, wherein said final crimping station includes a final crimping seat coupled to said base section of said compressor, and a final crimping mold coupled to said top section of said compressor and vertically aligned over said final crimping seat, said final crimping mold being spaced from said final crimping seat such that said final crimping mold is configured to finish crimping of the shell seated in said final crimping seat to close the open end of the shell.

8. The device of claim 1, further comprising said handle having a base portion, an upper portion, and an offset portion between said base portion and said upper portion, said base portion being rotatably coupled relative to said fixed section of said press.

9. The device of claim 8, further comprising said handle being rotatable such that said upper portion is selectively positionable between a lowered position and a raised position while said handle is in a pivoted position.

10. The device of claim 1, further comprising said compressor being removably coupled to said press.

11. The device of claim 1, further comprising each of said collet and said sleeve being removably coupled to said compressor such that collet and sleeve are interchangeable with a differently sized second collet and second sleeve whereby said compressor is configurable for resizing to a selectable desired shell size.

12. The device of claim 4, further comprising a distance between said wad insertion guide and said wad insertion seat when said compressor is fully compressed being adjustable whereby said wad insertion station is configured for holding and inserting wads into shells having a variety of different lengths.

13. The device of claim 6, further comprising a distance between said initial crimping seat and said initial crimping mold when said compressor is fully compressed being adjustable whereby said initial crimping station is configured for holding and initially crimping shells having a variety of different lengths.

14. The device of claim 7, further comprising a distance between said final crimping seat and said final crimping mold when said compressor is fully compressed being adjustable whereby said final crimping station is configured for holding and finally crimping shells having a variety of different lengths.

15. A shell reloader device comprising:

a press comprising a fixed section, a linkage, and a handle pivotally coupled to said fixed section, said handle being coupled to said linkage wherein said linkage is moved relative to said fixed section by operation of said handle; and a compressor, said compressor being removably coupled to said press, said compressor being operationally coupled to said press such that said compressor provides compression to each of a plurality of stations when said handle is operated, each of said stations being configured for holding a respective shell such that said respective shell is positioned to be acted upon by said compressor for respective associated steps in reloading each shell, said plurality of stations including a primer removal station, a resizing station, a primer insertion station, a wad insertion station, an initial crimping station, or a final crimping station, said compressor comprising a base section couplable to said linkage wherein said base section moves with said linkage, a top section, said top section being in a static position relative to said fixed section of said press wherein said base section is moved towards said top section by operation of said handle of said press, and a medial frame said medial frame being supported between said top section and said base section in a resting position over said base section, said medial frame being engaged by said bottom section and moved toward said top section when said base section is moved fully towards said top section;

wherein said primer removal station comprises a primer removal post coupled to and extending vertically upwards from said base section, said primer removal post having a distal end relative to said base section, and a primer removal aperture extending through said top section, said primer removal aperture being vertically aligned with said primer removal post such that said distal end of said primer removal post extends through said primer removal aperture when said compressor is fully compressed wherein said primer removal post is configured to push a used primer out of a shell and through said primer removal aperture;

wherein said resizing station comprises a collet coupled to said top section of said compressor, a sleeve coupled to said medial frame, said sleeve being positioned to compress said collet wherein said collet is configured for compressing and resizing a brass head of a shell inserted into said collet, and each of said collet and said sleeve being removably coupled to said compressor such that collet and sleeve are interchangeable with a differently sized second collet and second sleeve whereby said compressor is configurable for resizing to a selectable desired shell size;

wherein said primer insertion station comprises a priming mechanism coupled to said base section, said priming mechanism being configured to receive a primer and have a shell positioned on said priming mechanism over the primer, and a rod coupled to said top section, said rod being aligned over said priming mechanism wherein said rod is configured to compress the shell against the priming mechanism wherein the primer is inserted into the shell when the handle is operated;

wherein said wad insertion station comprises a wad insertion seat coupled to said base section, said wad insertion seat being configured for engaging a brass head of a shell, a wad insertion guide coupled to said base section and positioned over said wad insertion seat such that said wad insertion guide is configured to engage and hold an open end of the shell, said wad insertion guide having a wad insertion opening configured to be aligned with the open end of the shell, a wad tamper coupled to said top section of said compressor wherein said wad tamper is inserted through said wad insertion opening such that said wad tamper is configured for pressing a wad inserted into the open end of the shell towards the brass head when said handle is operated, said wad tamper being slidable towards said wad insertion seat wherein said wad tamper is configured for tamping the wad into the shell after said compressor is fully compressed, and a distance between said wad insertion guide and said wad insertion seat when said compressor is fully compressed being adjustable whereby said wad insertion station is configured for holding and inserting wads into shells having a variety of different lengths;

wherein said initial crimping station comprises an initial crimping seat coupled to said base section of said compressor, an initial crimping mold coupled to said top section of said compressor and vertically aligned over said initial crimping seat, said initial crimping mold being spaced from said initial crimping seat such that said initial crimping mold is configured to begin crimping of an open end of a shell seated in said initial crimping seat, and a distance between said initial crimping seat and said initial crimping mold when said compressor is fully compressed being adjustable whereby said initial crimping station is configured for holding and initially crimping shells having a variety of different lengths; and wherein said final crimping station comprises a final crimping seat coupled to said base section of said compressor, a final crimping mold coupled to said top section of said compressor and vertically aligned over said final crimping seat, said final crimping mold being spaced from said final crimping seat such that said final crimping mold is configured to finish crimping of the shell seated in said final crimping seat to close the open end of the shell, and a distance between said final crimping seat and said final crimping mold when said compressor is fully compressed being adjustable whereby said final crimping station is configured for holding and finally crimping shells having a variety of different lengths.

16. The device of claim 15, further comprising said handle having a base portion, an upper portion, and an offset portion between said base portion and said upper portion, said base portion being rotatably coupled relative to said fixed section of said press, said handle being rotatable such that said upper portion is selectively positionable between a lowered position and a raised position while said handle is in a pivoted position.

* * * * *